United States Patent [19]

Hams

[11] Patent Number: 4,533,133

[45] Date of Patent: Aug. 6, 1985

[54] METHOD AND APPARATUS FOR PREVENTING INSERTION ERRORS

[75] Inventor: Kenneth A. Hams, Easton, Pa.

[73] Assignee: Bell & Howell Company, Phillipsburg, N.J.

[21] Appl. No.: 425,220

[22] Filed: Sep. 28, 1982

[51] Int. Cl.[3] ..... B65H 5/26

[52] U.S. Cl. ..... 271/9; 271/11; 271/101; 271/263

[58] Field of Search ..... 271/9, 11, 100, 101, 271/110, 111, 263; 250/571

[56] References Cited

U.S. PATENT DOCUMENTS

| | | | |
|---|---|---|---|
| 3,731,916 | 5/1973 | Pettet | 271/263 |
| 4,013,283 | 3/1977 | Tress | 271/263 X |
| 4,255,057 | 2/1981 | Williams | 271/263 X |
| 4,391,439 | 7/1983 | Edström | 271/263 X |
| 4,428,041 | 1/1984 | Honkawa | 271/263 X |

*Primary Examiner*—Richard A. Schacher

*Attorney, Agent, or Firm*—Griffin, Branigan & Butler

[57] ABSTRACT

An insertion machine includes an insert supply station 10 located alongside a conveyor 30. Associated with the supply station 10 are a selector 16 for deflecting a lowermost piece of material 15 contained in a hopper 12; a separator foot 25 for segregating the deflected piece from the hopper 12; a monitoring means 40 for determining whether only the lowermost piece 15 was, in fact, deflected; and, a gripper arm 18 for extracting the lowermost piece 15 and depositing the same on the conveyor 30. In one embodiment, the monitoring means 40 comprises an infrared source 29 which directs a signal to a sensor 27 mounted in the separator foot 25.

26 Claims, 5 Drawing Figures

METHOD AND APPARATUS FOR PREVENTING INSERTION ERRORS

BACKGROUND

This invention pertains to insertion machines, and in particular to machines wherein an individual piece of material is pneumatically or otherwise deflected from a stack containing a plurality of pieces to facilitate eventual extraction and deposition of the individual piece onto a transport means.

U.S. Pat. No. 2,325,455 to A. H. Williams, incorporated herein by reference, discloses an insertion machine having a chain-like transport means powered by a rotating shaft in conjunction with various intermediate shafts and gears. Initially the transport means is indexed past a plurality of supply stations, including an envelope supply station and insert supply stations, from which corresponding materials are extracted and deposited onto the transport means. The transport means is then indexed past other stations which sequentially perform numerous individual functions, including opening an envelope flap; positioning the envelope at an inserting station; opening the envelope; inserting material into the envelope; moistening the envelope flap; closing the envelope flap; and, affixing a stamp to the envelope.

The supply stations described in the Williams patent and subsequent related devices include supply tables, or hoppers, having vertically stacked thereon numerous pieces of material, such as envelopes or insert material. Beneath each supply table is a selector comprising one or more sucker cups. Once during each machine cycle, a time period gauged by the rotational cycle of the machine, the selector moves first upwardly into the plane of the supply table and then downwardly therefrom so that, when a vacuum is applied through the sucker cups, the selector downwardly deflects an edge of the lowermost piece of material stacked on the table.

While the edge of the lowermost piece is being deflected in the above manner, a separation mechanism associated with the supply station interposes itself between the selector and the bottom of the supply table. Although the vacuum applied through the selector sucker cups may cease at this point, the edge of the lowermost piece remains deflected and is prevented by the separator mechanism from returning to the supply table.

Also associated with the supply station is a gripper jaw mechanism which swings inwardly beneath the supply table; engages the deflected edge of the lowermost piece between the gripper jaws; extracts the lowermost piece as it swings away from the supply table; and, deposits the piece of material on the transport means After deposition on the transport means in this manner, the piece of material is ushered downstream during the next machine cycle where other sequential functions, such as those mentioned above, are performed.

Although the operation as basically summarized above is efficient and advantageous when compared to other types of insertion mechanisms, problems do occur if the selector associated with any supply station either fails to deflect the lowermost piece of material contained therein (a "miss") or deflects other pieces of material in addition to the lowermost piece (a "double"). Such faulty operation of the selector may be either a random occurrence or, more seriously, a continuing mechanical malfunction of the selector such as, for example, an improper adjustment of vacuum pressure.

Unless the selectors are continually monitored, it is improbable that the malfunctions described above will be detected in time to be rectified. As a result, the selectors may preform erratically by either wastefully deflecting too many pieces or failing to deflect any pieces at all.

Even when the malfunction of a selector is detected, rectification of the malfunction is painstaking and costly. Typically, the entire insertion machine must be shut down while an operator attempts to manually locate and correct the situation. Deactiviation of the machine in this manner, even for a brief period of time, requires numerous machine cycles and, therefore, involves a significant lost volume of production.

Various insertion machines currently available detect double or miss errors, the more significant of these devices including those embodied in the following U.S. Pat. Nos. 3,744,787 and 3,885,780 to Morrison, and 4,013,283 and 4,132,402 to Tress et al. These devices basically gauge the amount of material extracted from a supply station by either (1) determining the degree of jaw separation when a gripper jaw is employed, or (2) determining the degree of roller separation when a pull-foot mechanism is employed. In either type of device, the degree of separation is transmitted by a moveable electrode which grounds double or miss electrical contacts when a malfunction occurs. An object of this invention, however, is to provide an alternate means for accurately monitoring the selection of pieces of material from a supply station of an insertion machine.

An advantage of the invention is the provision of means to permit the selector means of an insertion machine to quickly and automatically correct random malfunctions of the selector means.

Another advantage of the invention is the capability of distinguishing between the random, correctable malfunctions of a selector means and the continuing mechanical malfunction of the selector means.

Accordingly, a further advantage of the invention is the temporal and financial economy realized in efficiently monitoring and maintaining an insertion machine without manual intervention.

SUMMARY

An insertion machine of the invention comprises monitoring means for detecting the quantity of pieces of material removed from a supply station. The monitoring means determines whether a single piece of material is deflected from the supply station for extraction therefrom, or whether the machine has malfunctioned by deflecting either a plurality of pieces or no pieces at all.

According to one embodiment, the monitoring means includes a source which directs infrared energy toward the piece(s) of material deflected from a material supply. An infrared detector, mounted on a separator means positioned between the material supply and the deflected piece(s), gauges the received infrared energy after the energy has penetrated the deflected piece(s). The detector produces an electrical signal proportional to the energy received and thusly indicative of the thickness of material deflected from the material supply.

When the monitoring means perceives that the insertion machine has malfunctioned by deflecting an incorrect number of pieces of material, electrical signals from the monitoring means deactivate the malfunctioning supply stations during the machine cycle wherein the malfunction occurs. During this cycle the supply stations which are functioning properly are allowed to complete the extraction process. However, during the following machine cycle a transport means travelling past the supply stations is stopped and the extraction process is inhibited at all but the malfunctioning supply stations. During this and subsequent (if necessary) machine cycles the malfunctioning stations are given repeated opportunities to deflect a single piece of material. When the number of successive malfunctions for any station exceeds a preselected input value, the entire insertion machine is deactivated. However, should a malfunctioning supply station correct itself before this point, all the supply stations and the transport means are reactivated so that normal operation may be continued.

BRIEF DESCRIPTION OF THE DRAWINGS

The foregoing and other objects, features, and advantages of the invention will be apparent from the following more particular description of preferred embodiments as illustrated in the accompanying drawings in which like reference characters refer to the same parts throughout the various views. The drawings are not necessarily to scale, emphasis instead being placed upon illustrating principles of the invention.

DETAILED DESCRIPTION OF THE DRAWINGS

Figure 1:
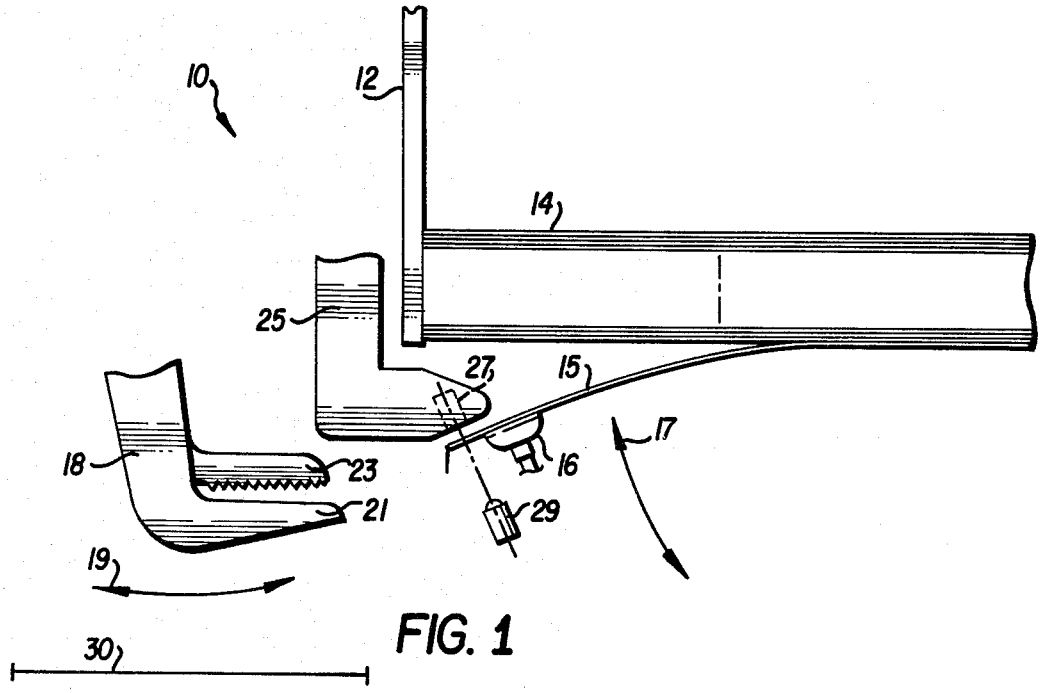
FIG. 1 is a side view of an insertion supply station.

FIG. 1 illustrates an insertion supply station 10 which basically resembles the supply station of U.S. Pat. No. 2,325,455 to A. H. Williams. Insertion supply station 10 has a supply means, such as supply table or hopper 12 which has vertically stacked therein a plurality of pieces of material 14, including a lowermost piece 15. In this respect, the stack 14 may be a plurality of envelopes, insert material, or the like.

Beneath the supply table 12 is a deflecting means, or selector 16, which is adapted for periodic upward and downward movement (as depicted by arrow 17) relative to the plane of the bottom of the supply table 10. The selector 16 comprises one or more suction cups in fluid communication with a vacuum in the manner shown in the aforementioned Williams patent. It should be understood, however, that various other devices may be provided for selector 16, including a vacuum shuttle plate as disclosed in U.S. Pat. No. 3,844,551 to Morrison.

FIG. 1 also shows a portion of an extracting means, such as gripper arm 18, associated with the insertion supply station 10. Although not shown as such in FIG. 1, it can be seen from the aforementioned Williams patent that an upper end of the gripper arm 18 is connected to a rotating shaft for moving the gripper arm 18 in both clockwise and counterclockwise directions (as depicted by arrow 19) to and from the supply station 10. The other end, or lower end, of gripper arm 18 comprises a stationary jaw 21 and a gripping jaw 23.

Also associated with the insertion supply station 10 is a separator means, like separator foot 25, which also periodically swings toward and away from the supply hopper 12 in the manner generally depicted by arrow 19. When the separator foot 25 is positioned directly beneath the hopper 12 as shown in FIG. 1, a sensor 27 mounted in the separator foot 25 is in alignment with a transmitting means 29. In one embodiment, the sensor 27 is a phototransistor and the transmitting means 29 is a light emitting diode (LED) suitable for transmitting infrared (IR) energy.

Running alongside the insertion supply station 10 is a transport means, such as conveyor 30. As seen in FIG. 1, conveyor 30 appears to travel into the plane of the drawing. Conveyor 30 may be any conventional type of conveyor, but for purposes of the ensuing discussion shall be deemed to be a chain-like transport.

Figure 2:
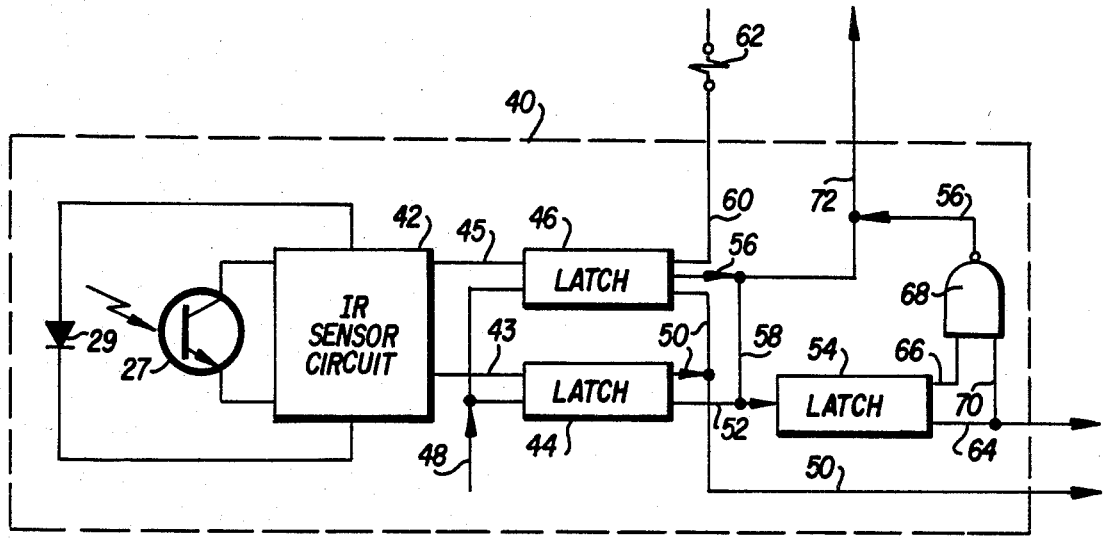
FIG. 2 is a block diagram of monitoring means for an insertion supply station.

FIG. 2 illustrates a monitoring means 40 associated with an insertion supply station according to one embodiment of the invention. In this particular embodiment, monitoring means 40 includes the phototransistor 27, the LED 29, and an IR sensor circuit 42 (hereinafter described with reference to FIG. 5).

One output terminal of circuit 42 is connected by wire 43 to a first latch, or "miss" latch 44, while the other output terminal is connected by wire 45 to a second latch, or "double" latch 46. Both latches 44 and 46 also have input terminals connected to a strobe line 48 which originates at a clock (not shown). Both latches 46 and 44 also have output terminals connected to a fault bus 50 which exits from the monitoring means 40 for electrical connection in the manner hereinafter described with reference to FIG. 3.

A second output terminal of "miss" latch 44 is connected by a wire 52 to a second cycle latch 54. Similarly, a second output terminal of the "double" latch 46 is connected to the second cycle latch 54 by wires 56, 58, and 52.

A third output terminal of "double" latch 46 has connected thereto a wire 60 leading to a separator control means 62 which, in one embodiment of the invention, comprises a solenoid.

The second cycle latch 54 has two output terminals; the first has connected thereto a second cycle fault bus 64, a second is connected by a wire 66 to a first input terminal of a NAND gate 68. A second input terminal of NAND gate 68 is connected to bus 64 by a wire 70. An output terminal of NAND gate 68 is connected to the wire 56.

The monitoring means 40 is electrically connected to insertion disabling means (not shown) by a wire 72. The disabling means comprises means for activation and deactivation for such members as selector 16 and the vacuum applied thereto. The disabling means is electrically connected to "miss" latch 44 by wires 52, 58, 56, and 72; to "double" latch 46 by wires 56 and 72; and, to NAND gate 68 by wires 56 and 72.

Figure 3:
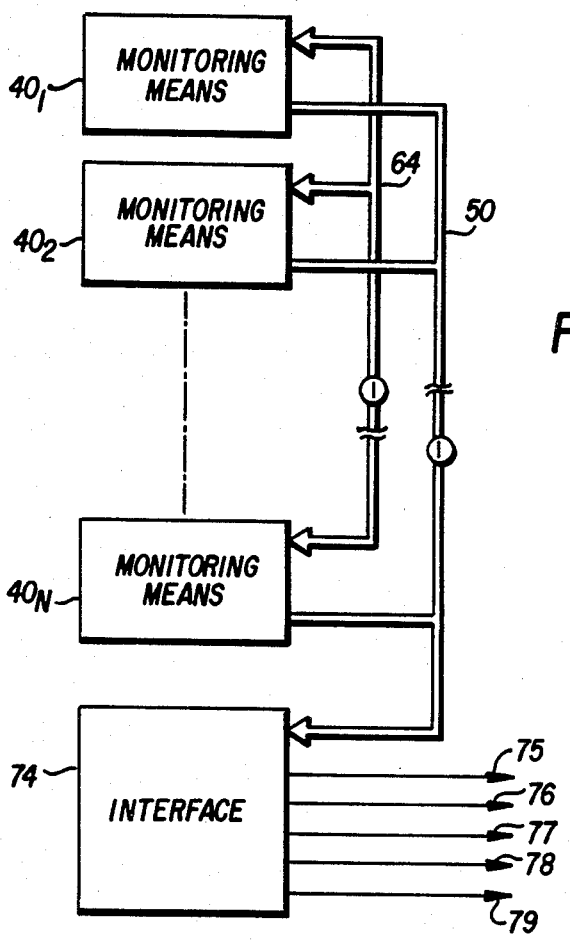
FIG. 3 is a block diagram showing the electrical connection of monitoring means for a plurality of insertion supply stations.

FIG. 3 illustrates the electrical connection of a plurality of monitoring means associated with a plurality of insertion supply stations. In particular, monitoring means $40_1$ is associated with a first insertion supply station, monitoring means $40_2$ with a second insertion supply station, and so on up to monitoring means $40_N$ which is associated with insertion supply station N.

As discussed with reference to FIG. 2, each monitoring means is connected to both the fault bus 50 and the second cycle fault bus 64, each bus containing one wire. Although the second cycle fault bus 64 is connected only to the various monitoring means for the respective insertion supply stations, the fault bus 50 is also connected to an interface unit 74.

Interface unit 74 has various electrical wires emanating therefrom, such as wires 75, 76, 77, 78, and 79. These wires connect the unit 74 with various other disabling means associated with other portions of the insertion machine. For example, wire 75 leads to a clutch for stopping and starting the conveyor 30 travelling alongside the insertion supply stations; line 76 leads to an envelope supply station (not shown); line 77 leads to an envelope flap detection station (not shown); line 78 leads to a envelope moistener station (not shown); and, line 79 leads to a switch for terminating operation of the entire insertion machine (also not shown).

Figure 4:
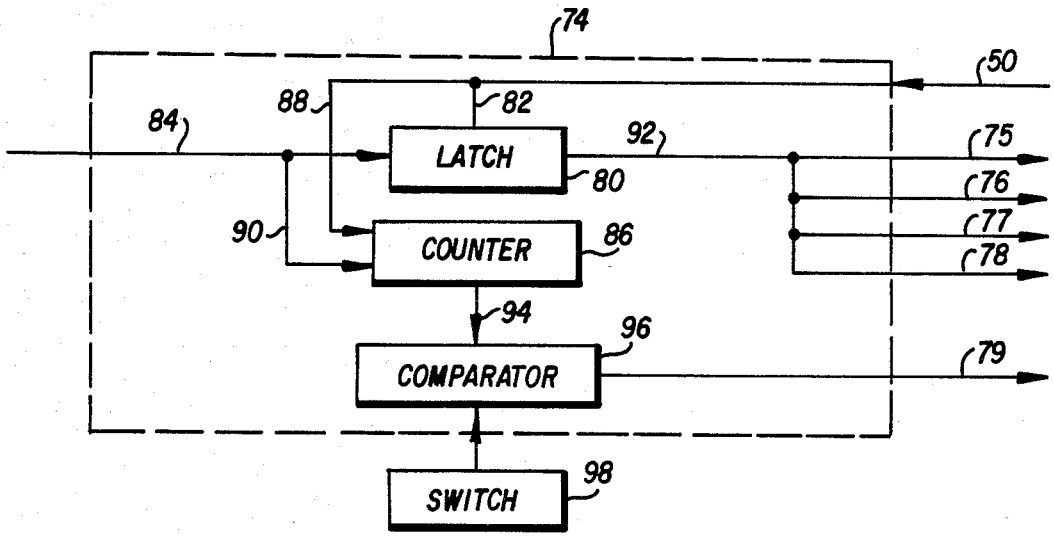
FIG. 4 is a block diagram of an unit designed to electrically interface monitoring means with other portions of an insertion machine; and, FIG. 5 is an electrical circuit depicting a portion of the monitoring means of FIG. 2.

The components included in the interfacing unit 74 are illustrated in FIG. 4. A fault cycle latch 80 has a first input terminal connected by a wire 82 to the fault bus 50. A second input terminal of latch 80 is connected to a clock (not shown) by a strobe line 84. Similarly, a counter 86 has a first terminal connected to bus 50 by a wire 88 and a second input terminal connected to the clock by wires 84 and 90.

The output terminal of fault cycle latch 80 is connected to wire 92 which branches into the wires 75, 76, 77, and 78 discussed hereinbefore. An output terminal of counter 86, on the other hand, is connected by a wire 94 to a first input terminal of a comparator 96. The comparator 96 has a second input terminal connected to a switch 98. An output terminal of comparator 96 is connected to the wire 79 discussed previously.

The switch 98 is of a type that may be selectively adjusted through a range of numbers for generating an appropriate electrical signal indicative of the selected number. Although discussed with reference to the interface unit 74, it should be understood that the switch 98 may be remote from the unit 74 and manually preset by an operator.

Figure 5:
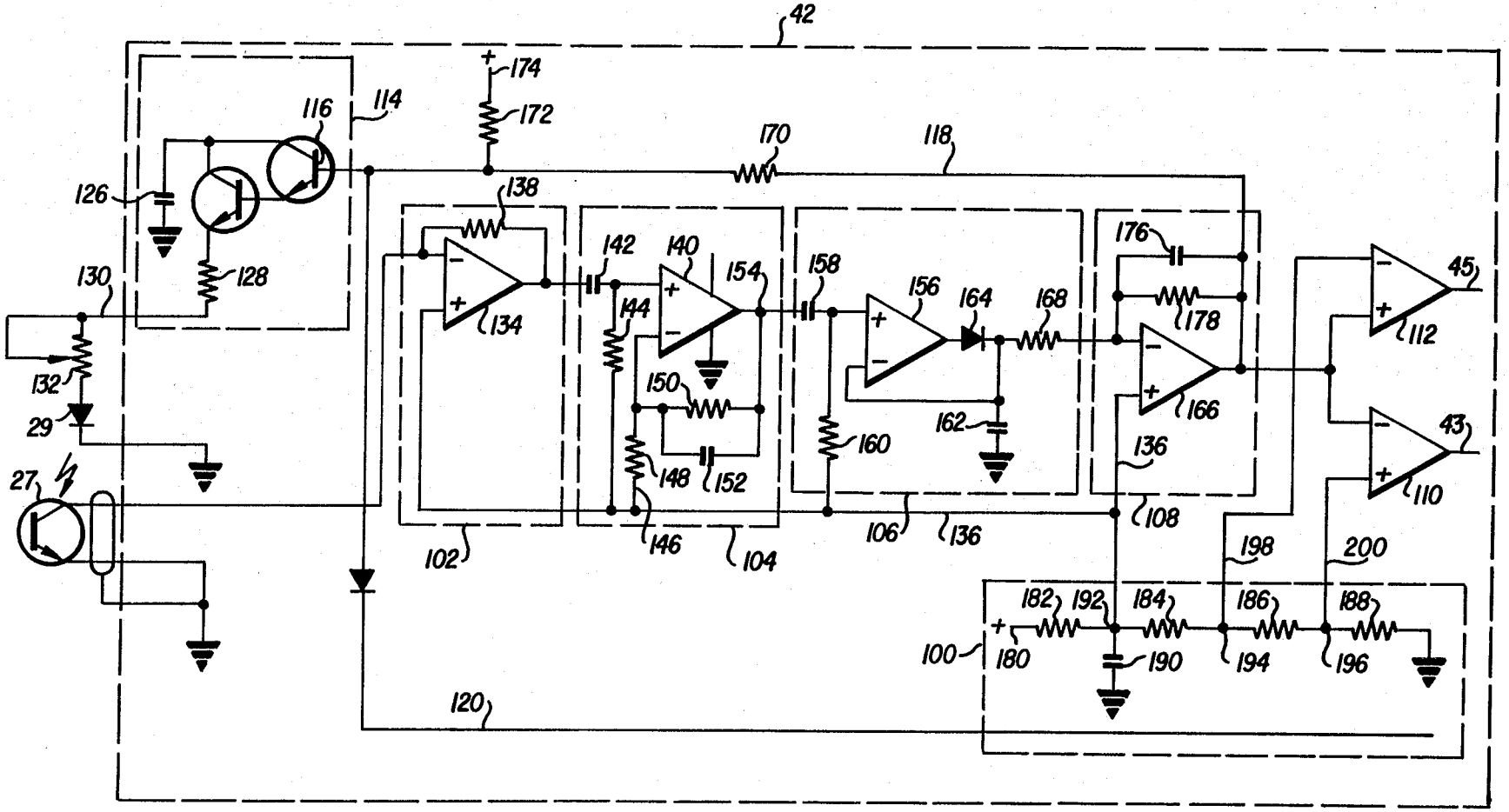

The IR sensor circuit 42 is shown in FIG. 5. Basically, the circuit 42, operating in conjunction with the LED 29 and the phototransistor 27, comprises a voltage divider network 100; a current to voltage converter network 102; a AC amplifier network 104; a peak detector network 106; a DC amplifier network 108; a first operational amplifier 110; a second operational amplifier 112; and, a power transistor 114.

The power transistor 114 may be, for example, a General Electric D40C4N transistor connected as an emitter follower with the infrared LED 29 in the emitter circuit. Base 116 serves as an input terminal of the power transistor 114 and is connected both to the D.C. amplifier network 108 by wire 118 and to a source for a 4 KHz AC signal (not shown) by wire 120. Power transistor 114 is biased at point 124, preferrably at 24 volts, and operates in conjunction with capacitor 126 and resistor 128. An output terminal of power transistor 114 is connected by a wire 130 to a potentiometer 132 which is in series with the LED 29.

Phototransistor 27 is arranged such that infrared energy will be incident thereon when the separator foot 25 of the insertion supply station assumes the configuration of FIG. 1. The collector of phototransistor 27 is connected to an inverting input of an operational amplifier 134 which is part of the current to voltage converter network 102. The non-inverting input terminal of operational amplifier 134 is connected to the voltage divider network 100 by a reference voltage line 136. A resistor 138 is connected from the inverting input terminal to an output terminal of the operation amplifier 134.

The output terminal of the operational amplifier 134 is connected to the non-inverting input of the A.C. amplifier 140 through a high pass filter comprising a capacitor 142 and a resistor 144, resistor 144 being connected intermediate the capacitor 142 and the reference voltage line 136. An inverting input terminal of the A.C. amplifier 140 is connected to the voltage divider network 100 by reference voltage line 136 and wire 146 which has thereon a resistor 148. A parallel combination of a resistor 150 and a capacitor 152 is connected between the inverting input terminal and an output terminal (at point 154) of the A.C. amplifier 140.

Output terminal 154 of the A.C. amplifier network 104 is connected to an non-inverting input terminal of the operational amplifier 156 (included in the peak detector network 106) by a filter comprising a capacitor 158 and a resistor 160, resistor 160 being connected intermediate the capacitor 158 and the voltage reference line 136. An inverting input terminal of the operational amplifier 156 is connected to a capacitor 162. An output terminal of the operation amplifier 156 is also connected to the capacitor 162 through a diode 164 connected therebetween.

An inverting input terminal of an operational amplifier 166 is connected to the peak detector network 106 by a resistor 168 which is separately connected to both the diode 164 and the capacitor 162. A non-inverting input terminal of the operational amplifier 166 of the D.C. amplifier network 108 is connected to the voltage divider network 100 by the voltage reference line 136.

An output terminal of the operational amplifier 166 branches for separate connection with an inverting input terminal of the operational amplifier 110 and with a non-inverting input terminal of the operational amplifier 112. The output terminal of the operation amplifier 166 is also connected by wire 118 to the power transistor 114. In this respect, a resistor 170 is intermediate the output terminal of the amplifier 166 and the power transistor 114 on line 118, and a resistor 172 connected to a voltage source at point 174 is connected to wire 118 at a point intermediate resistor 170 and the power transistor 114. Connected in parallel fashion between the inverting input terminal of the operation amplifier 166 and wire 118 is a capacitor 176 and a resistor 178.

The voltage divider network 100 is biased at point 180 by a source (preferrably 15 volts) and comprises resistors 182, 184, 186, and 188, as well as a capacitor 190. When these resistors and capacitor are assigned the value suggested hereinafter, point 192 in network 100 assumes the value of 10 volts, point 194 assumes the value of 7 volts, and point 196 assumes the value of 5 volts. In this regard, point 194 is connected by a wire 198 to the inverting input of operational amplifier 112, and point 196 is connected by wire 200 to the non-inverting input of the operational amplifier 110.

As discussed previously, the operational amplifiers 110 and 112 are each connected to the output terminal of the operational amplifier 166. The output terminal of operational amplifier 110 is connected to the "miss" latch 44 by wire 43 at the output terminal of the operational amplifier 112 is connected to the "double" latch 46 by wire 45 (both connections illustrated in FIG. 2).

It should be understood that various values may be used for the resistors and capacitors described above so long as those values are conducive to the manner of operation described hereinafter. The following two tables indicate appropriate component values for an embodiment of aspects of the invention about to be described.

| SUGGESTED RESISTOR VALUES | |
|---|---|
| ELEMENT NUMBER | RESISTANCE IN OHMS |
| 128 | 50 |
| 132 | 10K |
| 138 | 330 |
| 144 | 1K |
| 150 | 330 |
| 160 | 22K |
| 168 | 1K |
| 170 | 10K |
| 172 | 100K |
| 178 | 100K |
| 182 | 1.5K |
| 184 | 1K |
| 186 | 680 |
| 188 | 1.5K |

| SUGGESTED CAPACITANCE VALUES | |
|---|---|
| ELEMENT NUMBER | CAPACITANCE IN MICROFARADS |
| 126 | 25 |
| 142 | 0.01 |
| 152 | 0.30 |
| 158 | 0.01 |
| 162 | 0.47 |
| 176 | 0.47 |
| 190 | 25 |

In operation, one or more insertion supply stations 10 are positioned along the conveyor 20. It should be understood that while the ensuing discussion concerns the operation of a supply station containing pieces of material to be inserted into an envelope, the operational steps could equally apply to an upstream supply station which contains the envelopes into which material is later inserted.

After a stack of material 14 has been loaded into the hopper 12, and after the insertion machine has been turned on, once during each machine cycle the selector 16 moves up into the plane of the hopper 12. A vacuum applied through the selector 16 sucks the lowermost piece of material 15 from stack 14 onto the selector 16. At this point, the selector 16 drops down from the hopper 12 deflecting at least a portion of the lowermost piece of material 15 as it descends.

During this same machine cycle the separator foot 25 travels in between the hopper 12 and the selector 16 so that it assumes the position depicted in FIG. 1. While the lowermost piece of material 15 is still engaged by the selector 16, the LED 29 transmits a signal of infrared energy toward the phototransistor 27, the path of travel of the signal being through the thickness of the deflected lowermost piece of material 15. At this point, as hereinafter described, the IR sensor circuit determines whether the selector 16 has incorrectly deflected more than one piece of material or no pieces at all.

Just prior to the alignment of the LED 29 and the phototransistor 27, when there is no signal yet incident on the phototransistor 27, the output of the DC operational amplifier 166 is at the 10 volt reference level (since no signal is applied to the inverting input terminal of amplifier 166 while a 10 volt signal is applied to the non-inverting input terminal from point 192). The 10 volt reference level is applied on line 118 to the power transistor 114, which is also modulated with a 4 KHz square wave on wire 120. Thus, the LED 29 current is also a square wave with a maximum peak value of approximately 160 milliamperes. The potentiometer 132 connected in series with the LED 29 is used to adjust the sensitivity of the amplifier circuit in order to take into consideration the thickness of the individual pieces of material contained in the hopper 12, since the thicknesses may differ from one job to the next.

When the phototransistor 27 swings into alignment with the LED 29 as shown in FIG. 1, the infrared energy causes the phototransistor 27 to conduct, thereby applying a current to the inverting input of operational amplifier 134. As described above, the operational amplifier 134 is connected as a current-to-voltage converter with a relatively low output voltage change for the range of detector current. As such, the operational amplifier 134 does not saturate for relatively high levels of ambient light. Any component actually due to artificial ambient light (probably in the neighborhood of 120 Hz) is blocked by the high pass filter (capacitor 142 and resistor 144) before the output of the operational amplifier 134 is supplied to the AC amplifier 140.

When the above suggested values are used for the resistors and capacitors of the IR sensor circuit 42, the AC amplifier 140 provides a gain of 330 for the 4 KHz AC signal. The amplified signal is then applied to the peak detector network 106, and in particular to the operational amplifier 156, which charges capacitor 162 to a voltage equal to the sum of the 10 volt reference level plus the peak of the 4 KHz AC signal.

Since the charge on capacitor 162 is applied to the inverting input terminal of the DC amplifier 166 and the 10 volt reference voltage is applied from point 192 to the non-inverting input terminal, only the DC change due to the 4 KHz signal is amplified and inverted to reduce the voltage at the output terminal of the amplifier 166. This reduction in voltage is fed back on wire 118 through the power transistor 114 to decrease the LED 29 excitation.

Thus, the LED 29 current is low when no material is present between it and the phototransistor 27. The amplifier 116 changes the LED 29 current to maintain the same phototransistor illumination as the thickness or number of pieces of material is increased. The gain of amplifier 116 may be adjusted using the resistor 170 in series with the LED 29.

The voltage signal from the output terminal of operational amplifier 166 is indicative of whether the selector 16 has deflected a single, double, or miss. In this respect, when the suggested resistor and capacitor values are used, if the output voltage from operational amplifier 166 is less than 5 volts (indicating an abnormally high level of energy at phototransistor 27), operational amplifier 110 produces an output indicating that a miss occurred at the supply station. If the output signal from operation amplifier 166 exceeds 7 volts (indicating an abnormally low level of energy detected at phototransistor 27), the operational amplifier 112 produces an output indicating that a plurality of pieces of material were deflected by the selector 16. In the normal case, the deflection of a single piece of material, the output of the operational amplifier 166 is between 5 and 7 volts and neither operational amplifier 110 nor 112 produce an output.

If the IR sensor circuit 42 determines that either a miss or a double is occurring at the insertion supply station, the circuit 42 either gates an output pulse on wire 43 to the miss latch 44 or gates an output pulse on wire 45 to the double latch 46. In both cases (a miss or a double) the output from either latch is used to deactivate during the current machine cycle only the vacuum associated with the faulty station. Additionally, when a double deflection occurs, double latch 46 provides a signal to separator control means 62 on wire 60 to deactivate the separator foot 25 and retrieve the foot 25 from its position beneath the hopper 12, thereby allowing the deflected pieces of material to return to the stack 14. In one embodiment, the separator control means 62 is a solenoid designed to retract the separator foot 25.

During the machine cycle in which a double or miss is detected, either miss latch 44 or double latch 46 will provide a signal on fault bus 50 which, as shown in FIG. 3, leads to the interface unit 74. As will be seen hereinafter, during the subsequent machine cycle the interface unit 74 uses this signal in order to temporarily suppress other machine functions.

When the machine cycle in which the double or miss was detected has terminated, a signal originating at the machine clock and corresponding to the beginning of another machine cycle is applied on strobe line 48 to both the miss latch 44 and the double latch 46, thereby enabling the appropriate latch (the latch receiving a signal from the IR sensor circuit 42) to provide an input signal for the second cycle latch 54. In this respect, the signal may be provided to the second from latch 44 on wire 52 or from latch 46 on wires 56, 58, and 52. The second cycle latch 54 then applies a signal to the wire 66 (connecting latch 54 to the NAND gate 68) and to the second cycle fault bus 64.

As shown in FIG. 3, the second cycle fault bus 64 is connected to each of the insertion supply stations. Those insertion supply stations which receive a signal on second fault bus 64 during this subsequent cycle but which did not themselves detect a double or a miss, will have only one signal applied to the NAND gate 68. That is, those supply stations not detecting a miss or a double will not have a signal on wire 66 which forms the second input to the NAND gate 68. NAND gate 68, having differing inputs in this manner, will produce a signal on wire 56 and 72 to deactivate the vacuum associated with the faulty station which did not detect a miss or a double. At those stations where a miss or a double was detected, on the other hand, the NAND gate 68 will have like input signals and will not provide a signal on wires 56 and 72, thus allowing the vacuum associated with the faulty station to function during this subsequent machine cycle while the insertion supply stations which operated normally during the previous cycle are deactivated.

While the signal is provided on strobe line 48 to latches 44 and 46 to indicate the commencement of another, or second, machine cycle, a similar signal is applied from the machine clock on wire 84 to the fault cycle latch 80 and on wire 84 and 90 to the counter 86. The signal on wire 84 enables the latch 80 to disengage various other machine functions during the machine cycle which is subsequent to the machine cycle in which the double or miss was detected. In particular, latch 80 provides a signal on line 75 to disengage a pin clutch (not shown); on wire 77 to deactivate a downstream envelope back flap detector; and, on wire 78 to deactivate an envelope flap moistener.

As described above, the detection of a miss or a double at any insertion supply station deactivates that station during the machine cycle in which the malfunction occurred. During the subsequent machine cycle, however, all the supply stations are deactivated except those stations where a malfunction occurred. In this subsequent machine cycle all other machine functions are deactivated in order to allow the malfunctioning station(s) to correct themselves. That is, the selector 16, the separator foot 25, and the monitoring means 40 associated with the malfunctioning station(s) are allowed to repeat during the subsequent cycle.

If during the subsequent cycle the IR sensor circuit 42 indicates that the previously malfunctioning station is now correctly operating, no signal is applied to either latch 44 or 46 and hence there is no signal on buses 50 or 64. During the following (third) machine cycle the entire machine can resume normal operation.

If during the subsequent machine cycle the IR sensor circuit 42 indicates that the malfunction was repeated, either latch 44 or latch 46 again causes a signal to be placed on bus 50 and bus 64. In like manner as described above, during the next (third) machine cycle all the machine functions except the malfunctioning supply stations will be deactivated. These steps continue in loop-fashion until the value stored in the counter 86 exceeds the preset input value selected on switch 98. If and when the number of repeat exceeds the preset input value, as determined by the comparator 96, the entire machine is deactivated by a signal generated on wire 79.

At the beginning of the second machine cycle the timing signal received from the counter 86 over wires 84 and 90 from the machine clock enable the counter 86 to increment the numerical value stored therein. The counter 86 will continue to increment once during each machine cycle as long as there is a signal applied on fault bus 50 and wire 88. The counter 86 is cleared (set to zero) when a signal no longer appears on the fault bus 50 and the wire 88.

Operation of the insertion machine as described above provides an automatic check for the quantity of material deflected from each insertion supply station. The machine is able to automatically monitor malfunctions and to attempt to remedy random, correctable malfunctions which occur.

While the invention has been particularly shown and described with reference to preferred embodiments thereof, it will be understood by those skilled in the art that various alterations in form and detail may be made therein without departing from the spirit and scope of the invention. For example, instead of providing a transmitting means 29 in a sensing means 27 on the separator foot 25, the means 29 and 27 may be provided on the gripper arm 18.

I claim:

1. An insertion machine having at least one supply station located alongside a transport means, said machine comprising:

supply means at said supply station containing at least one piece of material;

selector means for selecting at least a portion of said material as being subject to extraction from said supply means;

monitoring means for detecting the quantity of material selected from said supply means by said selector means, said monitoring means further comprising:

(1) transmitting means for directing an infrared signal toward said selected material;

(2) means for receiving said infrared signal; and, (3) means for determining whether the magnitude of said received infrared signal is in an acceptable range; and, gripper means for extracting said selected material from said supply means and for depositing said extracted material on said transport means if said magnitude of said received infrared signal is in said acceptable range.

2. The machine of claim 1 wherein said selector means deflects said material and is in fluid communication with a vacuum.

3. The machine of claim 1 further comprising:

separator means for selective positioning between said supply means of said selector means to prevent said piece of material from returning to said supply means after said piece of material is deflected.

4. The machine of claim 3 wherein said sensing means is located on said separator means.

5. The machine of claim 3 further comprising:

a plurality of supply stations, each supply station having associated therewith a supply means, a selector means, a monitoring means, a gripper means, and a separator means.

6. An insertion machine having a plurality of supply stations located alongside a transport means, said machine comprising:

supply means at a plurality of said supply stations, said supply means containing at least one piece of material;

selector means at a plurality of said supply stations, said selector means being activatable to select at least a portion of said material as being subject to extraction from said supply means;

monitoring means for detecting whether a proper quantity of material is selected from said supply means by said selector means; and, activation control means at a plurality of said supply stations, said activation control means being connected both to said monitoring means and said selector means for (1) temporarily deactivating said selector means at each supply station where it is determined that an improper quantity of material is selected; and for (2) subsequently (a) reactivating said selector means at said stations where it is determined that an improper quantity of material was selected, and (b) temporarily deactivating said selector means at other supply stations where it is determined that a proper quantity of material was selected.

7. The machine of claim 6 further comprising:

disabling means electrically connected to each of said monitoring means and connected to said transport means for temporarily stopping said transport means when it is determined that an improper quantity of material is selected at any supply station.

8. The machine of claim 6 wherein said selector means deflects said material and is in fluid communication with a vacuum.

9. The machine of claim 6 wherein said activation control means is further connected to said separator means for temporarily retracting said separator means from between said supply means and said selector means at a supply station where it is determined that an improper quantity of material is selected.

10. The machine of claim 6 wherein each of said supply stations is an insert supply station, and wherein said machine further comprises an envelope supply station located upstream and alongside said transport means, and wherein said disabling means is further connected to said envelope supply station to temporarily suppress the supply of envelopes when it is determined that an improper quantity of material is selected at any insert supply station.

11. The machine of claim 6, further comprising counter means for counting and storing a value corresponding to the number of sequential occurrences of the selection of an improper quantity of material.

12. The machine of claim 11 further comprising:

switch means for containing a preset value;

comparison means for comparing the value stored in said counter means with said preset value; and, stop means for terminating operation of the machine when said value stored in said counter exceeds said preset value.

13. The machine of claim 6, wherein said monitoring means further comprises:

(1) transmitting means for directing a signal toward said selected material;

(2) means for receiving said transmitted signal; and, (3) means for determining whether the magnitude of said received signal is in a normally acceptable range or is an abnormal magnitude.

14. The machine of claim 13 wherein said signal is infrared energy.

15. A method of operating an insertion machine comprising the steps of:

selecting at least a portion of material contained in a supply means as being subject to extraction from said supply means;

monitoring the quantity of material selected from said supply means, said monitoring step further comprising the steps of:

(1) transmitting an infrared signal toward said selected material; and, (2) sensing the magnitude of transmissibility of said infrared signal; and, (3) determining whether said sensed magnitude is in a normally acceptable range or is an abnormal magnitude;

extracting said selected material from said supply means if the sensed magnitude of said infrared signal is in said normally acceptable range; and, depositing said piece of extracted material on a transport means positioned alongside said supply means.

16. The method of claim 15 wherein said deflecting step comprises applying a vacuum to said piece of material.

17. The method of claim 15 further comprising the step of:

temporarily stopping said transport means when an abnormal signal is detected.

18. The method of claim 15 further comprising the step of:

separating by a separator means said selected piece of material by positioning said separator means between said supply station and said selector means.

19. The method of claim 18 further comprising the step of:

temporarily deactivating said separator means at supply stations where said sensed signal has an abnormal magnitude.

20. The method of claim 15 further comprising the steps of:

storing a preset numerical value;

counting the number of sequential occurrences of the reception of signals having abnormal magnitudes;

comparing said number of said sequential occurrences with said preset numerical value; and, terminating operation of the machine when said number of said sequential occurrences exceeds each preset numerical value.

21. A method of operating an insertion machine having a plurality of insert supply stations, each insert supply station having material supply means and selector means, said method comprising the steps of:

activating said selector means to select at least a portion of material contained in said supply means as being subject to extraction from said supply means;

monitoring the quantity of material selected from said supply means;

temporarily deactivating during a first time period said selector means at each supply station where it is determined that an improper quantity of material is selected;

extracting during a first time period said selected material from said supply means whereat it is determined that a proper quantity of material is selected;

depositing said extracted material on a transport means positioned alongside said supply means;

reactivating during a second time period said selector means which are deactivated during said first time period; and, temporarily deactivating during said second time period said selector means which were not deactivated during said first time period.

22. The method of claim 21 further comprising the steps of:

temporarily deactivating during said first time period extracting means at each supply station where it is determined that an improper quantity of material is selected;

reactivating during said second time period said extracting means which were deactivated during said first time period; and temporarily deactivating during said second time period said extracting means which were not deactivated during said first time period.

23. The method of claim 21 further comprising the step of:

separating by a separator means said selected piece of material by positioning said separator means between said supply station and said selector means.

24. The method of claim 23 further comprising the step of:

temporarily deactivating said separator means at supply stations where it is determined that an improper quantity of material is selected.

25. The method of claim 21 further comprising the steps of:

storing a preset numerical value;

counting the number of sequential occurrences of the selection of an improper quantity of material;

comparing said number of said sequential occurrences with said preset numerical value; and, terminating operation of the machine when said number of said sequential occurrences exceeds said preset numerical value.

26. The method of claim 21, wherein said monitoring step further comprises the steps of:

(1) transmitting a signal toward said selected material;

(2) receiving said signal transmitted toward said selected material; and, (3) determining whether the magnitude of said received signal is in a normally acceptable range or is an abnormal magnitude.

* * * * *